US008205374B2

(12) United States Patent
Lamm

(10) Patent No.: US 8,205,374 B2
(45) Date of Patent: Jun. 26, 2012

(54) PISTOL CARRIER

(75) Inventor: Charles R. E. Lamm, Buenos Aires (AR)

(73) Assignee: Powertech S.A., Montevideo (UY)

( * ) Notice: Subject to any disclaimer, the term of this patent is extended or adjusted under 35 U.S.C. 154(b) by 324 days.

(21) Appl. No.: 12/667,846

(22) PCT Filed: Jul. 10, 2007

(86) PCT No.: PCT/IB2007/003056

§ 371 (c)(1), (2), (4) Date: Jan. 12, 2010

(87) PCT Pub. No.: WO2009/007776

PCT Pub. Date: Jan. 15, 2009

(65) Prior Publication Data

US 2010/0154272 A1 Jun. 24, 2010

(51) Int. Cl.
*F41C 23/12* (2006.01)

(52) U.S. Cl. ..... 42/72

(58) Field of Classification Search ..... 42/71.01, 42/71.02, 72, 73, 74; 24/115 G, 193; 224/676, 224/575, 250

See application file for complete search history.

(56) References Cited

U.S. PATENT DOCUMENTS

| | | | | |
|---|---|---|---|---|
| 28,433 | A | 5/1820 | Alsop | |
| 22,626 | A | 1/1859 | Colt | |
| 32,003 | A | 4/1861 | Savage | |
| 202,946 | A | 4/1878 | Johnson | |
| 287,741 | A | 10/1883 | Vickers, Jr. | |
| 305,537 | A | 9/1884 | Schwatka | |
| 461,480 | A | 10/1891 | Kellar | |
| 517,555 | A | 4/1894 | Reed | |
| 562,487 | A | 6/1896 | Quackenbush | |
| 570,145 | A | 10/1896 | Pittavino | |
| 593,890 | A | 11/1897 | Houston | |
| 681,392 | A | 8/1901 | Fugate | |
| 723,545 | A * | 3/1903 | Phillips | 224/581 |
| 724,327 | A | 3/1903 | Phillips | |
| 762,862 | A | 6/1904 | Phillips | |
| 815,609 | A | 3/1906 | Martin | |
| 914,675 | A | 3/1909 | Renfors | |
| 931,328 | A | 8/1909 | Marble | |

(Continued)

FOREIGN PATENT DOCUMENTS

| | | |
|---|---|---|
| AT | 410141 | 2/2003 |

(Continued)

*Primary Examiner* — Stephen M Johnson
*Assistant Examiner* — Jonathan C Weber
(74) *Attorney, Agent, or Firm* — Notaro, Michalos & Zaccaria P.C.

(57) ABSTRACT

A shoulder weapon carrier system comprising a shoulder stock (10) attached to a pistol (3), said stock (10) being releasably supported by means of a slide assembly (119) to a supporting box (167) on a user's belt. In a preferred embodiment, the shoulder weapon carrier system comprises: a pistol (3) comprising ≧frame and having a transverse slot at the bottom of the frame and transverse holes in the upper rear of the frame; a shoulder stock (10) comprising a stock body comprising a butt (31), a cross pin that is adapted for engagement with the transverse slot and studs that are adapted for engagement with the two transverse holes; a slide assembly (119) that is slidably mounted on said stock body, said slide assembly (119) comprising a slide tongue (131) having a slide hook; a supporting box (167) having an opening that is adapted for receiving said slide tongue (131).

19 Claims, 7 Drawing Sheets

U.S. PATENT DOCUMENTS

| | | | |
|---|---|---|---|
| 961,511 | A | 6/1910 | Marble |
| 1,016,695 | A | 2/1912 | Kimmel |
| 1,150,763 | A | 8/1915 | High |
| 1,222,264 | A | 4/1917 | Cabanne |
| 1,266,632 | A | 5/1918 | Sachs |
| 1,266,633 | A | 5/1918 | Sachs |
| 1,315,215 | A | 9/1919 | Jackson |
| 1,367,996 | A | 2/1921 | Sussman |
| 1,477,445 | A | 3/1923 | Petritsch |
| 1,554,556 | A | 9/1925 | Camus |
| 1,557,865 | A | 10/1925 | Neel et al. |
| 1,877,016 | A | 9/1932 | Munson |
| 2,293,128 | A | 8/1942 | Fortin |
| 2,433,151 | A | 12/1947 | Parsons |
| 2,789,742 | A | 4/1957 | De Salvo |
| 2,841,847 | A | 7/1958 | Wallace |
| 2,873,902 | A | 2/1959 | Decker |
| 3,162,966 | A | 12/1964 | La Coss |
| 3,609,902 | A | 10/1971 | Casull |
| 3,641,694 | A | 2/1972 | Seidel et al. |
| 3,648,396 | A | 3/1972 | Smith |
| 3,740,886 | A | 6/1973 | Canon |
| 3,798,818 | A | 3/1974 | Casull |
| 3,861,273 | A | 1/1975 | Seidel et al. |
| 4,271,623 | A | 6/1981 | Beretta |
| 4,291,482 | A | 9/1981 | Bresan |
| 4,342,410 | A | 8/1982 | Sloan |
| 4,383,384 | A | 5/1983 | Fox |
| 4,788,785 | A | 12/1988 | White |
| 4,843,749 | A | 7/1989 | Griffith |
| 5,092,070 | A | 3/1992 | Perkins |
| 5,732,867 | A | 3/1998 | Perkins et al. |
| 5,778,588 | A | 7/1998 | Allen, III et al. |
| 5,924,233 | A | 7/1999 | Strobel |
| 6,161,741 | A | 12/2000 | French |
| 6,367,187 | B2 | 4/2002 | Bubits |
| 6,560,911 | B2 | 5/2003 | Sharp |
| 6,575,343 | B2 | 6/2003 | Mossman |
| 6,729,061 | B1 | 5/2004 | DeJarnette, Jr. |
| 2005/0035163 | A1 | 2/2005 | French et al. |

FOREIGN PATENT DOCUMENTS

| | | |
|---|---|---|
| FR | 59237 | 5/1954 |

* cited by examiner

PISTOL CARRIER

BACKGROUND OF THE INVENTION

This invention relates to an auxiliary stock to be attached to a pistol handle to convert it into a shoulder-gun and the resulting weapon. In particular, the invention relates to pistol carrier.

The background art is characterized by U.S. Pat. Nos. 22,626; 28,433; 32,003; 202,946; 287,741; 305,537; 461,480; 517,555; 562,487; 570,145; 593,890; 681,392; 724,327; 762,862; 815,609; 914,675; 931,328; 961,511; 1,016,695; 1,150,763; 1,222,264; 1,266,632; 1,266,633; 1,367,996; 1,477,445; 1,554,556; 1,557,865; 1,877,016; 2,293,128; 2,433,151; 2,789,742; 2,841,847; 2,873,902; 3,162,966; 3,609,902; 3,641,694; 3,648,396; 3,740,886; 3,798,818; 3,861,273; 4,121,743; 4,271,623; 4,342,410; 4,788,785; 4,383,384; 4,843,749; 4,989,358; 5,092,070; 5,732,867; 5,778,588; 5,924,233; 6,161,741; 6,367,187; 6,560,911; 6,575,343; 6,729,061; and U.S. Patent Applications No. 2005/0035163; the disclosures of which patents and patent application are incorporated by reference as if fully set forth herein.

BRIEF SUMMARY OF THE INVENTION

One purpose of the invention is to make a service pistol easier and safer to carry. Another purpose is to improve the accuracy and ease of the handling of a service pistol. Another purpose is to provide a pistol-shoulder stock combination that can be disassembled and suspended from a belt. Another purpose is to prevent assailants from snatching a pistol from its bearer and firing it at him. Another purpose is to provide a practical alternative to Smart Gun technologies.

An object of preferred embodiments of the invention is to increase handgun accuracy. Another object of preferred embodiments of the invention is to enable a higher firing rate for a pistol. Another object of preferred embodiments of the invention is to decrease the amount of training needed to fire a handgun accurately. Another object of preferred embodiments of the invention is to prevent an assailant from snatching the weapon of a law enforcement officer. Another object of preferred embodiments of the invention is to allow a handgun bearer to use both hands without having to replace his weapon in its holster.

In a preferred embodiment, the invention is a pistol carrier system for use with a belt and a pistol comprising a frame and having a transverse slot at the bottom of the frame and two transverse holes in the upper rear of the frame, said pistol carrier system comprising: a shoulder stock comprising a stock body having a butt, a downward extension having a cross pin that is adapted for engagement with the transverse slot, and a clamp having two studs that are adapted for engagement with the two transverse holes; a slide assembly that is slidably mounted on said stock body, said slide assembly comprising a slide detent mechanism that is operative to temporarily maintain said slide assembly at a selected position on said stock body, and a slide tongue having a slide hook; a supporting box that is attachable to the belt, said supporting box having an opening and a cavity that are adapted for receiving and retaining said slide tongue.

Preferably, said supporting box comprises within said cavity a detent lever comprising: a detent lever lower arm and a detent lever upper arm comprising a detent cam; a detent lever spring that urges said detent cam into engagement with said slide hook; and a sliding bar comprising a sliding bar stud that is operative to move said detent lower lever arm between an unlocked position at which said detent cam is not engaged with said slide hook and a locked position at which said detent cam is engaged with said slide hook, said sliding bar being slidable between a high retention position that corresponds with said locked position and a low retention position that corresponds to said unlocked position by means of a button and being maintained in said high retention position or said low retention position by a sliding bar detent mechanism.

Preferably, said stock body is selected from the group consisting of: a wire stock comprising a first (e.g., left) arm and a second (e.g., right) arm upon which said slide assembly is slidable, said first arm having a first axis and said second arm having a second axis and being joined by said cross pin and a bridge, said second arm extending backward and being bent downward at substantially a ninety degree angle to form said butt, said first arm being extending backward and being bent downward and toward a substantially vertical plane containing said second axis of said second arm and said butt and joining said second arm, and said first arm and said second arm extending forward and then downward forming said downward extension and joining to form said cross pin; and a polymer stock comprising a rail along which said side assembly is slidable, an upper attachment clamp that supports said studs and a lower attachment clamp that supports said cross pin and having a gripping opening between said attachment clamps. Preferably, said should stock further comprises an upper attachment point and a lower attachment point, and said pistol carrier system further comprises: an adjustable sling comprising a cord that is slidably connected to said upper attachment point, a buckle and two snap hooks, one snap hook being fixed to said lower attachment point and the other being fixed to said buckle. Preferably, said buckle has a buckle eye and a buckle hole through which said cord passes, and said buckle comprises a buckle lever, one end of which is urged against said cord by a buckle spring and another end of which is depressible.

Preferably, the pistol carrier system further comprises: a holster to which said wire stock is attachable when it is disengaged from the pistol, said holster comprising a holster supporting tongue that is supported by said supporting box when said slide tongue is not supported by said supporting box. Preferably, said shoulder stock comprises an arm or rail having a plurality of slots, said slide assembly comprises a sliding bar having a relief cavity, and said slide detent mechanism comprises a lower detent sphere, an upper detent sphere, a detent spring and a detent cylinder that is disposed in said detent spring, said slide detent mechanism urging said lower detent sphere into one of said slots when said sliding bar is in a locked location and urging said upper detent sphere into said relief cavity when said sliding bar is in an unlocked location.

In another preferred embodiment, the invention is a pistol carrier system for use with a pistol comprising a frame and having a transverse slot at the bottom of the frame and two transverse holes in the upper rear of the frame, said pistol carrier system comprising: a shoulder stock comprising a stock body comprising a butt having a lower apex, a cross pin that is adapted for engagement with the transverse slot and two studs that are adapted for engagement with the two transverse holes, said stock body having a length; a slide assembly that is slidably mounted on said stock body, said slide assembly comprising a slide tongue having a slide hook; and a supporting box having an opening that is adapted for receiving said slide tongue, said supporting box comprising a detent lever comprising a detent lever lower arm and a detent lever upper arm comprising a detent cam, a detent lever spring that urges said detent cam into engagement with said slide hook, and a sliding bar comprising a sliding bar stud that is operative to move said detent lower lever arm to a position at which said detent cam is not engaged with said slide hook. Preferably, said stock body is selected from the group consisting of: a wire stock comprising a first arm and a second arm upon which said slide assembly is slidable, said first arm having a first axis and said second arm having a second axis and being joined by said cross pin and a bridge, said second arm extending backward and being bent downward at substantially a ninety degree angle to form said butt, said first arm being extending backward and being bent downward and toward a substantially vertical plane containing said second axis of said second arm and said butt and joining said second arm, and said first arm and said second arm extending forward and then downward forming said downward extension and joining to form said cross pin; and a polymer stock comprising a rail along which said side assembly is slidable, an upper attachment clamp that supports said studs and a lower attachment clamp that supports said cross pin and having a gripping opening between said attachment clamps.

Preferably, said should stock further comprises an upper attachment point located at a distance from the pistol hat is no greater than about half said shoulder stock length and a lower attachment point located at said lower apex of said butt, and said pistol carrier system further comprises: an adjustable sling comprising a cord that is slidably connected to said upper attachment point, a buckle and two snap hooks, one snap hook being fixed to said lower attachment point and the other being fixed to said buckle. Preferably, said buckle has a buckle eye and a buckle hole through which said cord passes, and said buckle comprises a buckle lever, one end of which is urged against said cord by a buckle spring and another end of which is depressible.

Preferably, the pistol carrier system further comprises: a holster to which said wire stock is attachable when it is disengaged from the pistol, said holster comprising a holster supporting tongue that is supported by said supporting box when said slide tongue is not supported by said supporting box. Preferably, said shoulder stock comprises an arm or rail having a plurality of slots, said slide assembly comprises a sliding bar having a relief cavity, and said slide detent mechanism comprises a lower detent sphere, an upper detent sphere, a detent spring and a detent cylinder that is disposed in said detent spring, said slide detent mechanism urging said lower detent sphere into one of said slots when said sliding bar is in a locked location and urging said upper detent sphere into said relief cavity when said sliding bar is in an unlocked location.

In yet another preferred embodiment, the invention is a shoulder weapon carrier system comprising: a pistol comprising a frame and having a transverse slot at the bottom of the frame and two transverse holes in the upper rear of the frame; a shoulder stock comprising a stock body comprising a butt, a cross pin that is adapted for engagement with the transverse slot and two studs that are adapted for engagement with the two transverse holes; a slide assembly that is slidably mounted on said stock body, said slide assembly comprising a slide tongue having a slide hook; and a supporting box having an opening that is adapted for receiving said slide tongue, said supporting box comprising a detent lever comprising a detent lever lower arm and a detent lever upper arm comprising a detent cam, a detent lever spring that urges said detent cam into engagement with said slide hook, and a sliding bar comprising a sliding bar stud that is operative to move said detent lower lever arm to a position at which said detent cam is not engaged with said slide hook.

Preferably, said stock body is selected from the group consisting of a wire stock comprising a first arm and a second arm upon which said slide assembly is slidable, said first arm having a first axis and said second arm having a second axis and being joined by said cross pin and a bridge, said second arm extending backward and being bent downward at substantially a ninety degree angle to form said butt, said first arm being extending backward and being bent downward and toward a substantially vertical plane containing said second axis of said second arm and said butt and joining said second arm, and said first arm and said second arm extending forward and then downward forming said downward extension and joining to form said cross pin; and a polymer stock comprising a rail along which said side assembly is slidable, an upper attachment clamp that supports said studs and a lower attachment clamp that supports said cross pin and having a gripping opening between said attachment clamps. Preferably, said should stock further comprises an upper attachment point and a lower attachment point, and said pistol carrier system further comprises: an adjustable sling comprising a cord that is slidably connected to said upper attachment point, a buckle and two snap hooks, one snap hook being fixed to said lower attachment point and the other being fixed to said buckle. Preferably, said buckle has a buckle eye and a buckle hole through which said cord passes, and said buckle comprises a buckle lever, one end of which is urged against said cord by a buckle spring and another end of which is depressible. Preferably, the pistol carrier system further comprises: a laser aiming device that is attached either to said pistol or to said shoulder stock.

In a further preferred embodiment, the invention is a weapon comprising: a pistol comprising a frame comprising a bottom portion and an upper rear portion and having a transverse slot in said bottom portion and two transverse holes in said upper rear portion; and a shoulder stock comprising a stock body comprising a butt, a cross pin that is adapted for engagement with said transverse slot, and two studs that are adapted for engagement with said two transverse holes. In yet another embodiment, the invention is a buckle for use on a sling comprising a cord, said buckle comprising: a buckle body comprising a center portion and two end portions, one end portion having a buckle eye and another end portion having a buckle hole through which said cord passes; a buckle spring; and a buckle lever pivoted at said center portion, one end of which is urged against said cord by said buckle spring and another end of which is depressible by a user.

Further aspects of the invention will become apparent from consideration of the drawings and the ensuing description of preferred embodiments of the invention. A person skilled in the art will realize that other embodiments of the invention are possible and that the details of the invention can be modified in a number of respects, all without departing from the concept. Thus, the following drawings and description are to be regarded as illustrative in nature and not restrictive.

BRIEF DESCRIPTION OF THE SEVERAL VIEWS OF THE DRAWINGS

The features of the invention will be better understood by reference to the accompanying drawings which illustrate presently preferred embodiments of the invention. In the drawings.

Figure 1:
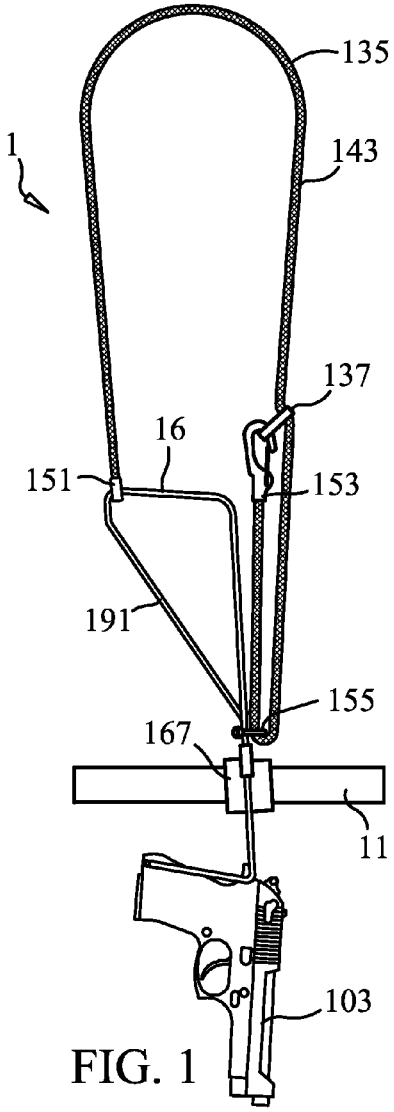
FIG. 1 is an elevation (side) view of a pistol carrier system in accordance with a preferred embodiment of the invention.

The following reference numerals are used to indicate the parts and environment of the invention on the drawings:

1 pistol carrier system
3 pistol carrier subassembly
10 shoulder stock, stock
11 user's belt, belt
12 pistol frame
14 polymer stock
15 stock body
16 wire stock
19 bridge
22 buckle hole
23 buckle body
24 buckle eye, buckle perforation
25 buckle lever
27 buckle axle
29 buckle spring
31 butt
37 closure flap
38 closure flap spring
43 relief cavity
44 locking slide
45 detent cylinder
46 upper detent sphere
47 detent ball
48 right detent ball cavity
49 left detent ball cavity
50 lower detent sphere
51 L-shaped detent lever, detent lever
52 detent spring
53 detent lever lower arm
54 detent lever spring
56 detent spring cavity
57 detent cam
58 detent lever upper arm
59 downward extension
61 cross pin, cross axle
63 left downward extension
64 right downward extension
65 pistol grip
73 holster assembly, holster
74 holster supporting tongue
75 holster clips
87 first arm, left arm
91 transverse slot
92 low retention position
93 high retention position
94 gripping opening
103 adapted pistol, pistol
104 lower attachment clamp
111 second arm, right arm
113 second arm slots
119 slide assembly
125 slide hook
129 slide T-slot
130 opening
131 slide tongue
133 sliding bar
134 cavity
135 adjustable sling, sling
136 button
137 sling adjustment buckle, buckle
143 sling braided cord, braided cord, cord
145 sling fixed end, fixed end
147 sling loop
149 sling loose end, loose end
151 sling lower attachment point, sling lower attachment shackle
153 sling snap hooks
155 sling upper attachment point, sling upper attachment shackle

164 clamp
165 studs
167 supporting box
171 T-rail
177 upper attachment clamp
179 tranverse holes, upper attachment holes
183 sliding bar stud
191 wire stock assembly
198 directions

DETAILED DESCRIPTION OF THE INVENTION

Referring to FIG. 1, a preferred embodiment of pistol carrier system 1 is presented. Pistol carrier system 1 is shown supported by belt 11. In this embodiment, pistol carrier system 1 comprises adapted pistol 103, wire stock assembly 191, supporting box 167 and sling 135. Sling 135 is attached to wire stock assembly 191 which preferably comprises wire stock 16, sling lower attachment point 151 and sling upper attachment point 155 which is attached to bridge 19 (see FIG. 5). Support box 167 is preferably attached to belt 11 by conventional means, e.g., belt loops or a Velcro® fastener. Sling 135 preferably loops over the shoulder of a user (not shown). Belt 11 is preferably non-elastic and 32 millimeters (mm) to 55 mm wide.

In a preferred embodiment, upper attachment point 155 is preferably located on shoulder stock 10, approximately in line with the longitudinal axis of the barrel of adapted pistol 103, in order for pistol carrier subassembly 3 to be optimally suspended from sling 135. In this embodiment, pistol carrier subassembly 3 hangs vertically from sling 135 when in use. If upper attachment point 155 is located too close to butt 31, the resulting relatively short length of sling 135 does not allow the user to lift the weapon and fire it from his shoulder. Moreover, upper attachment point 155 is preferably located along the upper edge of stock body 15, preferably in its forward half and no farther back than the middle of stock body 15. In an alternative embodiment, upper attachment point 155 is located closer to adapted pistol 103 than the middle of stock body 15.

In this embodiment, lower attachment point 151 is preferably located at the apex of butt 31 in a plane that substantially bisects stock body 15 as shown in FIG. 1. For a comfortable carry, the longitudinal axis of butt 31 is oriented parallel to the arm pit of the user. Therefore, upper attachment point 155 is preferably located at a distance from adapted pistol 103 that is no greater than about half the length of stock body 15 and lower attachment point 151 is preferably located at the lower apex of said butt 31, as shown in FIG. 1. If a wider butt 31 were provided and lower attachment point 151 were located on one side or the other of stock body 15, pistol carrier subassembly 3 would hang from sling 135 in a suboptimal, twisted orientation.

Figure 2:
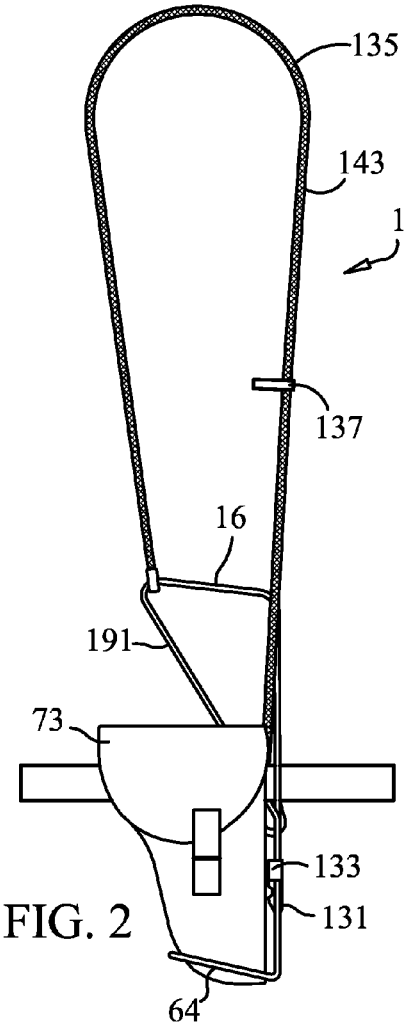
FIG. 2 is an elevation (side) view of a pistol carrier system in accordance with another preferred embodiment of the invention.
Figure 3:
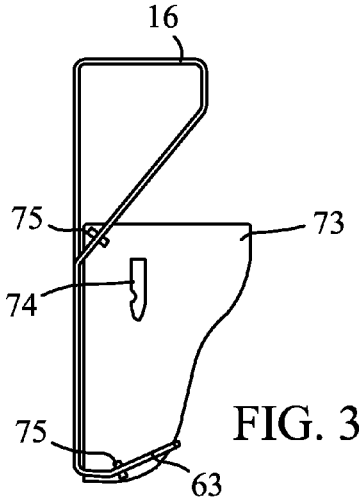
FIG. 3 is an elevation (side) view of a wire stock attached to a holster assembly in accordance with a preferred embodiment of the invention.

Referring to FIGS. 2 and 3, wire stock assembly 191 is shown attached to holster assembly 73 by means of holster clips 75. As is shown more clearly in FIG. 3, holster assembly 73 also includes holster supporting tongue 74 that is used to attach holster assembly 73 to supporting box 167. When pistol 103 and wire stock 16 are disassembled, pistol 103 is carried in holster 73 and wire stock 16 is attached to the outer surface of holster 73 with any suitable means (e.g., by holster clips 75). Holster 73 with wire stock 16 attached to it and containing pistol 103 is fixed to belt 11 through supporting box 167 with holster supporting tongue 74, which is similar to the one (slide tongue 131) forming part of slide assembly 119. In this configuration, downward extensions 63 and 64 are place on either side of holster 73. A conventional military holster, closed by a flap with a security lock and fabricated from a flexible material is preferred.

Figure 4:
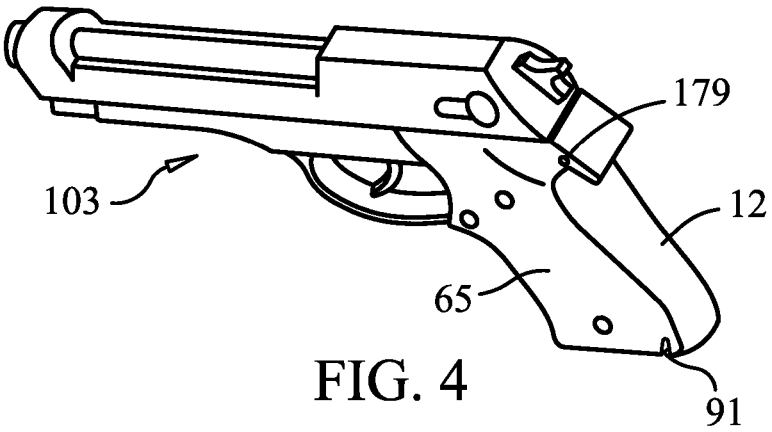
FIG. 4 is a perspective view of an adapted pistol in accordance with a preferred embodiment of the invention.

Referring to FIG. 4, a preferred embodiment of adapted pistol 103 is presented. In this embodiment, adapted pistol 103 comprises pistol frame 12 which includes pistol grip 65. Pistol frame 12 has transverse slot 91 at its bottom and two transverse holes 179 in its upper rear. Any pistol can be adapted to receive the stock if a transverse slot 91 can be provided in the bottom of frame 12 and two transverse holes 179 can be provided in the upper rear portion of frame 12.

Figure 5:
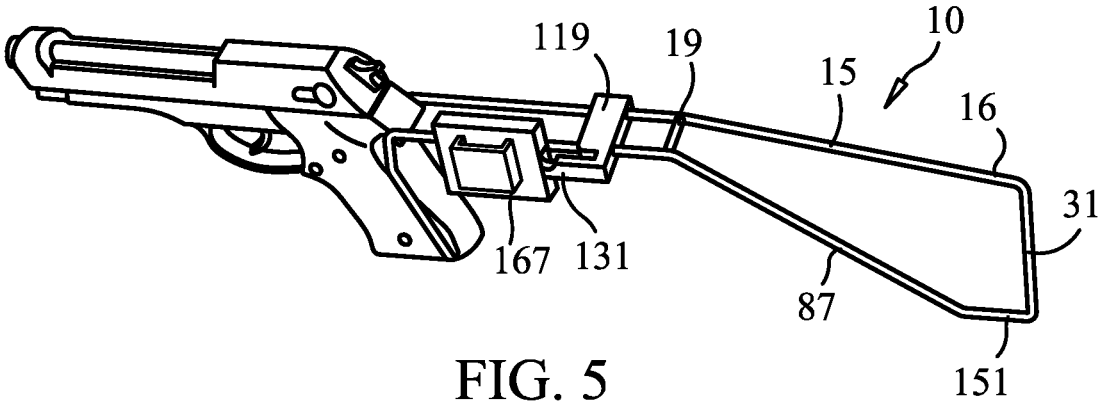
FIG. 5 is a perspective view of a pistol carrier subassembly in accordance with a preferred embodiment of the invention.

Referring to FIG. 5, another preferred embodiment of pistol carrier subassembly 3 is presented. In this embodiment, pistol carrier subassembly 3 comprises adapted pistol 103, shoulder stock 10 that is firmly attached to pistol 103, slide assembly 119 and supporting box 167. Supporting box 167 is preferably attached to user's belt 11. The structure of supporting box 167 is transparent in this view to reveal how slide assembly 119 and supporting box 167 interact. Preferably, sling lower attachment point 151 and sling upper attachment shackle 155 are provided as attachment points for sling 135. In a preferred embodiment, wire stock 16 is fabricated from steel wire or a duraluminum alloy wire. In a preferred embodiment, wire stock 16 has a relatively low weight (about 150 grams) and when attached to a pistol weighing about 1,000 grams produces a subassembly having a center of gravity near to the center of gravity of the pistol alone.

Figure 6:
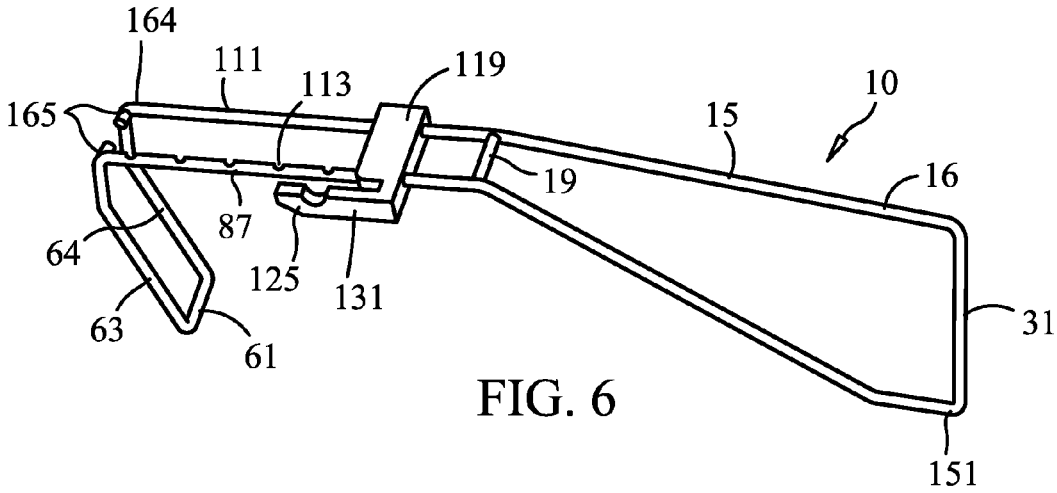
FIG. 6 is a perspective view of a wire stock in accordance with a preferred embodiment of the invention.

Referring to FIG. 6, a preferred embodiment of shoulder stock 10 is presented. In this embodiment, shoulder stock 10 comprises stock body 15 which comprises wire stock 16. Wire stock 16 preferably comprises first (e.g., left) arm 87 and second (e.g., right) arm 111 on which a plurality of second arm slots 113 are provided and upon which side assembly 119 is slidable. First arm 87 and second arm 111 are preferably joined by cross pin 61 and bridge 19. Second arm 111 is preferably extended backward and is bent downward at substantially a ninety degree angle to form butt 31. First arm 87 is preferably extended backward and is bent downward and toward a substantially vertical plane containing second arm 111 and butt 31 and is joined to second arm 111. First arm 87 and said second arm 111 preferably extend forward and then downward, thereby forming left downward extension 63 and right downward extension 64 that are joined to form cross pin or cross axle 61. Cross pin or cross axle 61 is adapted for engagement with transverse slot 91, and clamp 164 has two studs 165 that are adapted for engagement with two transverse holes 179.

Figure 7:
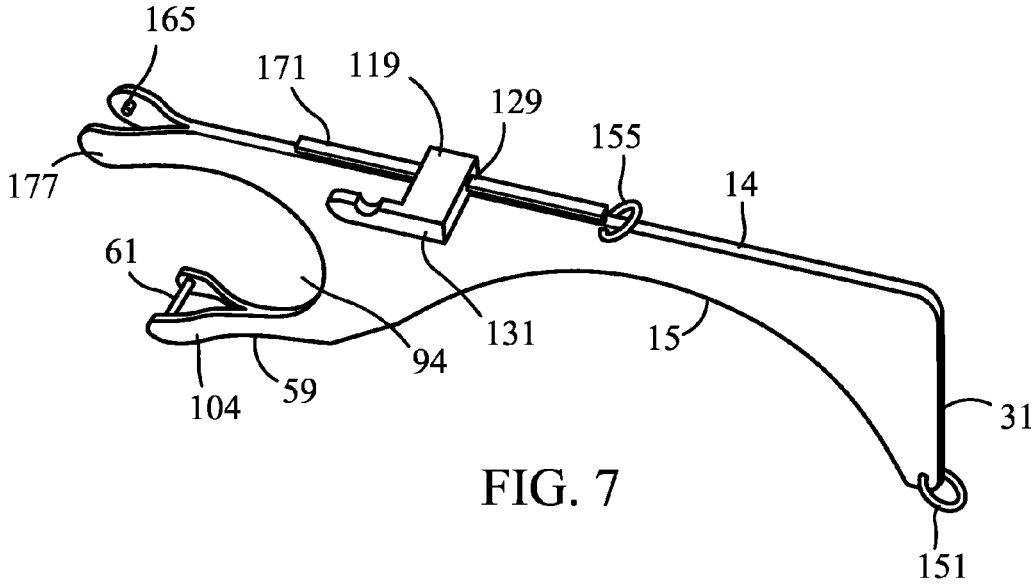
FIG. 7 is a perspective view of a polymer stock in accordance with a preferred embodiment of the invention.

Referring to FIG. 7, another preferred embodiment of stock body 15 is illustrated. In this embodiment, stock body 15 comprises polymer stock 14. Polymer stock 14 comprises T-rail 171 along which slide assembly 119 is slidable, upper attachment clamp 177 that supports studs 165 and downward extension 59 having lower attachment clamp 104 that supports cross pin 61. In a preferred embodiment, slide assembly 119 has slide T-slot 129 that accepts T-rail 171. In a preferred embodiment, polymer stock 14 has gripping opening 94 between attachment clamps 104 and 177. Preferably, sling lower attachment shackle 151 and sling upper attachment shackle 155 are provided as attachment points for sling 135.

Figure 8:
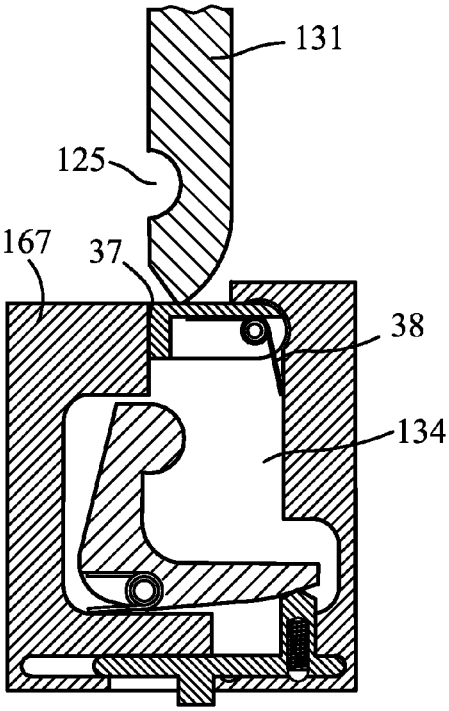
FIG. 8 is a cross sectional view of the supporting box of a preferred embodiment of the invention, with the proximal end of the slide tongue of a preferred embodiment of the invention is shown.
Figure 9:
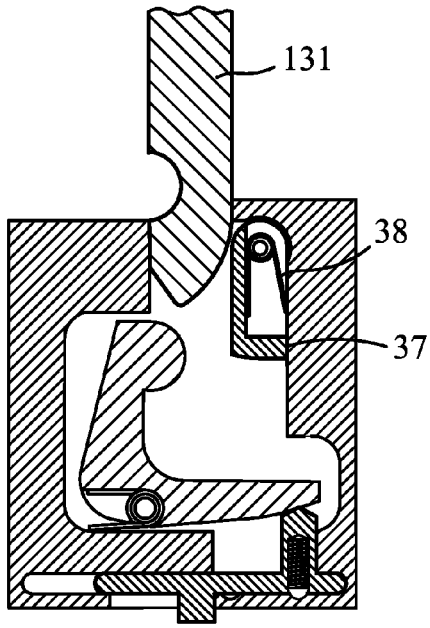
FIG. 9 is a cross sectional view of the supporting box of a preferred embodiment of the invention, with the proximal end of the slide tongue of a preferred embodiment of the invention is shown entering the supporting box.

Referring to FIGS. 8 and 9, a preferred embodiment of supporting box 167 is shown. The proximal end of slide tongue 131 is also shown. In this embodiment, closure flap 37 normally closes opening 130 because closure flap is urged toward the closed position by closure flap spring 38. When the end of slide tongue 131 presses on closure flap 37, closure flap 37 pivots away from opening 130, allowing slide tongue into cavity 134.

Figure 10:
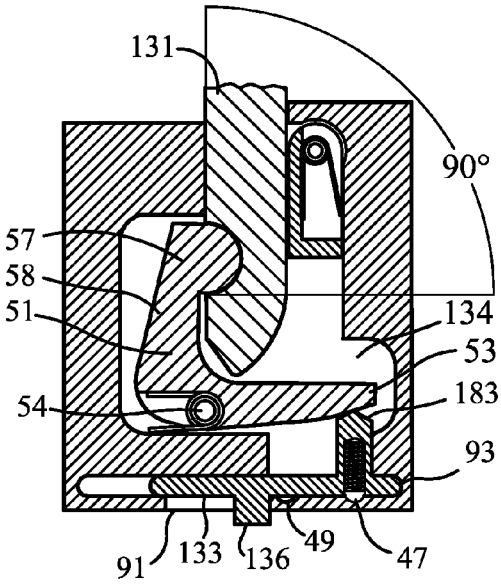
FIG. 10 is a cross sectional view of the supporting box of a preferred embodiment of the invention, with the mechanism in the locked position.
Figure 11:
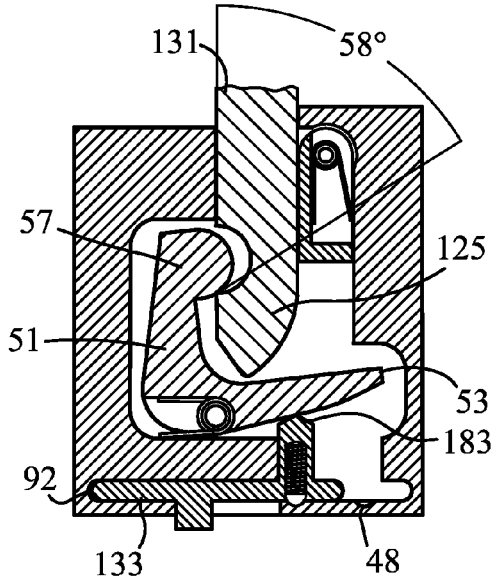
FIG. 11 is a cross sectional view of the supporting box of a preferred embodiment of the invention, with the mechanism in the unlocked position.
Figure 12:
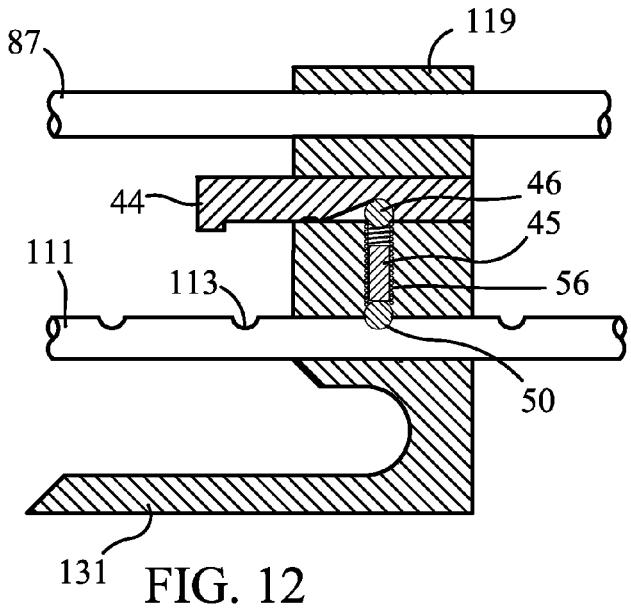
FIG. 12 is a cross sectional view of the slide assembly of a preferred embodiment of the invention. En this view, the sliding bar is in the unlocked mode.
Figure 13:
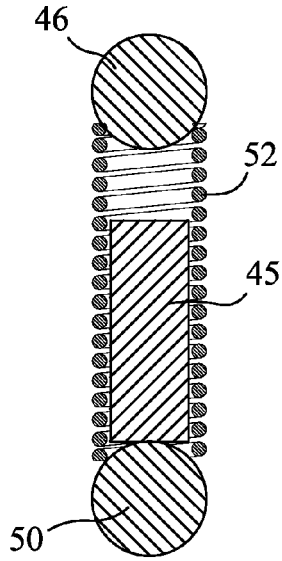
FIG. 13 is a cross sectional view of the detent spheres, detent spring and cylinder of the preferred embodiment of the invention illustrated in FIG. 12.
Figure 14:
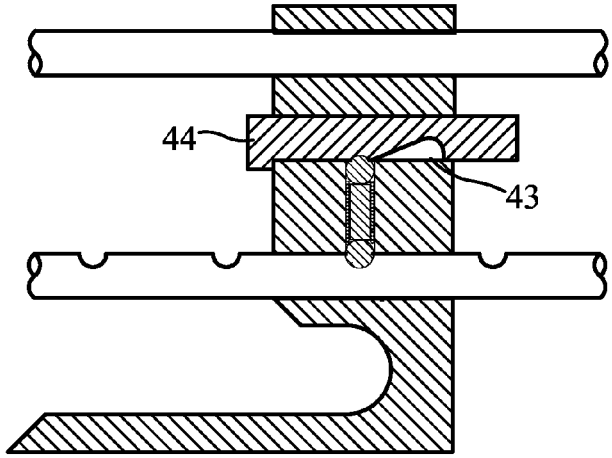
FIG. 14 is a cross sectional view of the slide assembly of a preferred embodiment of the invention. In this view, the sliding bar is in the locked mode.
Figure 15:
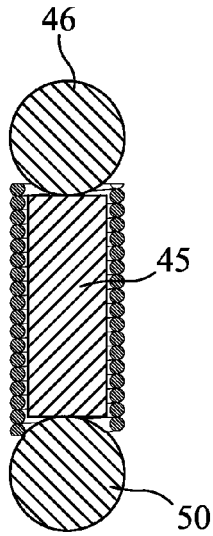
FIG. 15 is a cross sectional view of the detent spheres, detent spring and cylinder of the preferred embodiment of the invention illustrated in FIG. 14.

FIGS. 10 and 11 illustrate preferred embodiments of supporting box 167 and slide tongue 131, with the mechanism in the locked position and unlocked position, respectively. Supporting box 167 preferably has opening 130 and cavity 134 that are adapted for receiving slide tongue 131. Within cavity 134, supporting box 167 preferably comprises L-shaped detent lever 51 comprising: (1) detent lever lower arm 53 and detent lever upper arm 58 comprising detent cam 57, (2) detent lever spring 54 that urges detent cam 57 into engagement with slide hook 125, and (3) sliding bar 133 comprising sliding bar stud 183 and operating button 136. Sliding bar stud 183 is preferably operative to move detent lower lever arm 53 between an unlocked position at which detent cam 57 is not engaged with slide hook 125 as indicated by the preferred 58 degree angle in FIG. 11 and a locked position at which detent cam 57 is engaged with slide hook 125 in a locking engagement indicated by the preferred 90 degree angle in FIG. 10. Sliding bar 133 is preferably slidable by a user between high retention position 93 that corresponds with the locked position (as in FIG. 10) and low retention position 92 that corresponds to the unlocked position (as in FIG. 11) by means of button 136. Sliding bar 133 is preferably maintained in the high retention position or the low retention position by a sliding bar detent mechanism comprising detent ball 47 which rests in either right detent ball cavity 48 or left detent ball cavity 49.

Referring to FIG. 12 through 15, a preferred embodiment of slide assembly 119 is presented. Slide assembly 119 is preferably slidably mounted on arms 87 and 111 of stock body 15. Slide assembly 119 preferably comprises a slide tongue 131 having slide hook 125 and a slide detent mechanism that is operative to temporarily fix or lock slide assembly 119 at a selected position on stock body 15.

In a preferred embodiment, the slide detent mechanism comprises detent spring 52 that is disposed in detent spring cavity 56 that urges lower detent sphere 50 into one of the second arm slots 113 in second arm 111 and upper detent sphere 46 into detent cavity 43 on sliding bar 44. Detent cylinder 45 freely slides inside detent spring 52. In the detent mode shown in FIG. 12, sliding bar 44 is moved to the left and relief cavity 43 receives upper detent sphere 46 allowing sufficient space for lower detent sphere 50 to move up and out of second arm slot 113. In the locked mode shown in FIG. 14, sliding bar 44 is moved to the right and upper detent sphere 46 is pushed downward, out of relief cavity 43. Detent cylinder 54 is dimensioned to fill, in this mode, the space between detent spheres 46 and 50, thereby preventing lower detent sphere 50 from moving out of second arm slot 113 and positively locking slide assembly 119 at a desired location on right arm 111.

Figure 16:
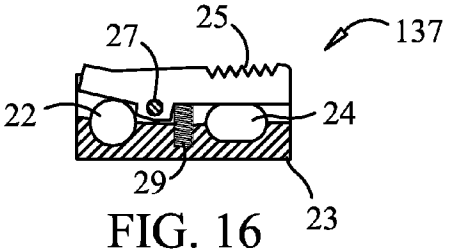
FIG. 16 is a cross sectional view of the sling adjustment buckle of a preferred embodiment of the invention. It this view, the braided cord of the sling of a preferred embodiment of the invention is not disposed in the hole in the buckle and the buckle lever is pressed downward.
Figure 17:
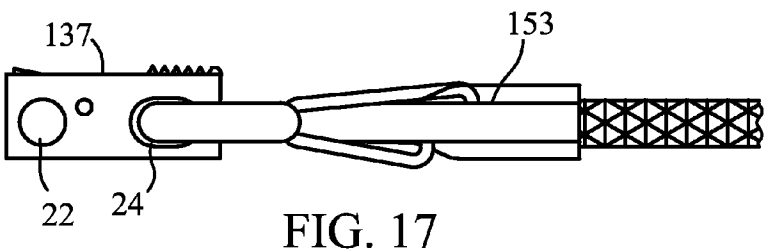
FIG. 17 is an elevation (side) view of the sling adjustment buckle of FIG. 16. It this view, one of the sling snap hooks is disposed in the buckle eye.
Figure 18:
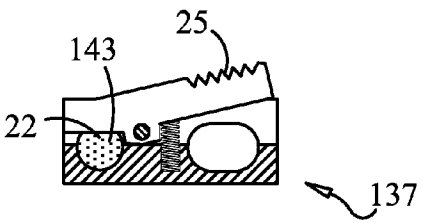
FIG. 18 is a cross sectional view of the sling adjustment buckle of a preferred embodiment of the invention with a braided cord passing through the hole in the buckle and the buckle lever is urged upward by the buckle spring.

Referring to FIG. 16 through 23, a preferred embodiment of sling adjustment buckle 137 is illustrated. FIG. 16 is a cross sectional view through buckle 137 without sling braided cord 143 disposed in buckle hole 22. FIG. 18 is a cross sectional view through buckle 137 with sling braided cord 143 disposed in buckle hole 22. Body 23 of buckle 137 is preferably made from a rigid material, such as aluminum or acetal resin. At one end of buckle body 23, buckle hole 22 is provided through which braided cord 143 can pass. In the middle of buckle body 23, buckle lever 25 is pivoted on buckle axle 27 and is urged in the counterclockwise direction by buckle spring 29.

Figure 19:
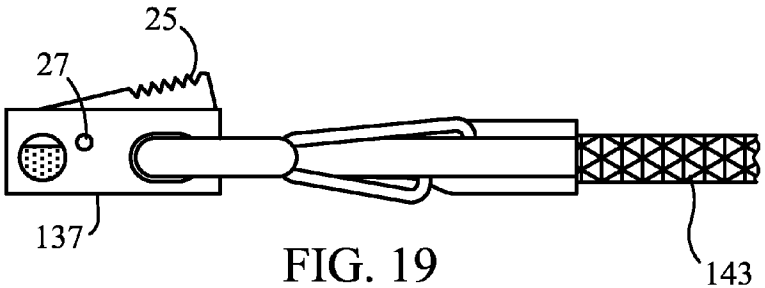
FIG. 19 is an elevation (side) view of the sling adjustment buckle of FIG. 18. It this view, one of the sling snap hooks is disposed in the buckle eye.
Figure 20:
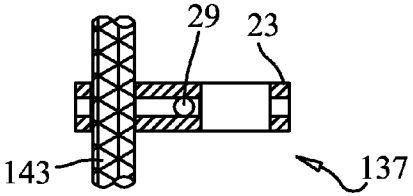
FIG. 20 is a cross sectional view of the buckle of a preferred embodiment of the invention and a portion of the braided cord with the buckle lever removed for clarity.
Figure 21:
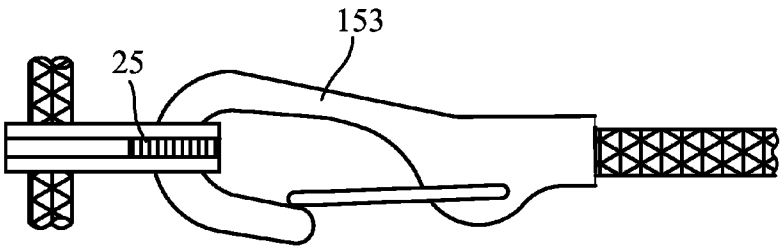
FIG. 21 is a plan (top) view of the buckle of a preferred embodiment of the invention with the braided cord passing through the hole in the buckle and one of the sling snap hooks is disposed in the buckle eye.

As illustrated in FIGS. 16 and 17, if a user presses buckle lever 25 down on its right extremity, its left extremity clears buckle hole 22. As illustrated in FIGS. 18 and 19, if braided cord 143 is disposed in hole 22 and buckle lever 25 is released, the left extremity of lever 25 is urged by spring 29 to press against braided cord 143, preventing braided cord 143 from sliding through buckle hole 22. In FIG. 20, in which buckle lever 25 is removed for clarity, buckle spring 29 is visible. FIG. 21 shows braided cord 143 passing through hole 22 in buckle 137 and one of the sling snap hooks 153 disposed in buckle eye 24.

Figure 22:
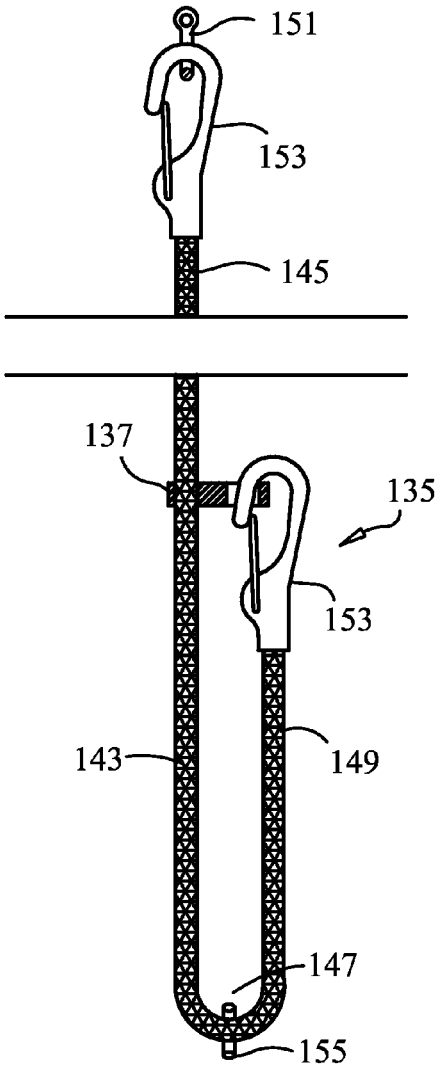
FIG. 22 is a side view of the sling of a preferred embodiment of the invention.
Figure 23:
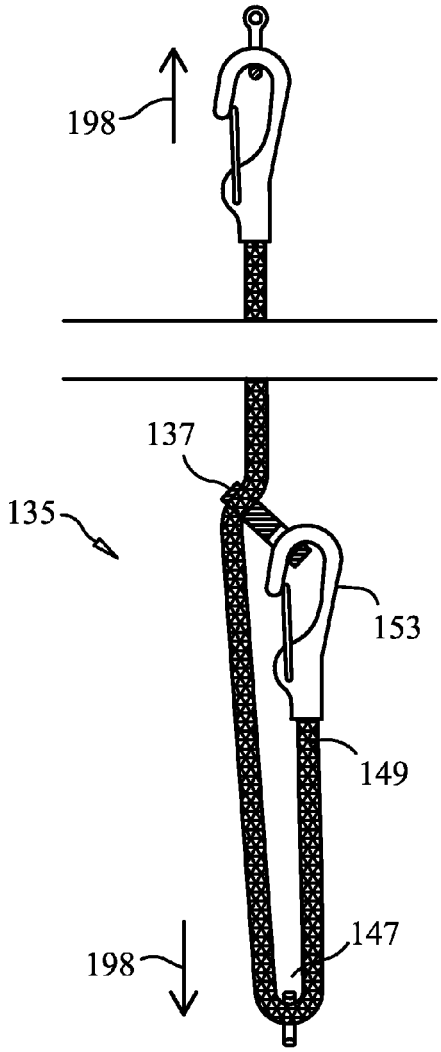
FIG. 23 is another side view of the sling of a preferred embodiment of the invention.

Referring to FIGS. 22 and 23, a preferred embodiment of sling 135 is presented. In this embodiment, sling 135 comprises braided cord 143 having sling fixed end 145 with one of the snap hooks 153, sling loose end 149 with another of the snap hooks 153 and sling adjustment buckle 137. In this embodiment, fixed end 145 of adjustable sling 135 is attached to sling lower attachment point 151 which is adjacent to the bottom of butt 31 and loose end 149 of sling 135 slides through upper attachment shackle 155 that is attached to the middle of the upper edge of stock 10 to form sling loop 147. If the snap hook 153 at loose end 149 is fixed at buckle 137, cord 143 forms a loop passing through upper attachment point shackle 155. Sling adjustment buckle 137 with loose end 149 attached is moved along sling braided cord 143 to adjust the sling length. If it becomes necessary to increase the sling length rapidly, it is sufficient to detach the sling snap hook 153 at loose end 149 from buckle 137, allowing cord 143 to slide through the lower attachment shackle 155 until it is stopped by snap hook 153.

As illustrated in FIG. 22, when no force is applied to sling 135, buckle 137 is oriented substantially normal (perpendicular) to cord 143 and is fixed in position by the pressure of lever 25 on cord 143. To easily move buckle 137 along cord 143, it is sufficient to press lever 25. However, while the force imposed on cord 143 by buckle lever 25 is sufficient to fix the location of buckle 137 on cord 143, it is not sufficient to lock buckle 137 in position if a strong force is applied to sling 135 (as in the case of an attacker intending to disarm the user of system 1). When a strong force is applied to sling 135 in directions 198, one of the snap hooks 153 pulls at buckle 137, rotating it and twisting cord 143 and locking buckle 137 in position as illustrated in FIG. 23.

In another preferred embodiment (not shown), a laser aiming device or (e.g., a tactical lamp) is attached to either pistol 103 or to said shoulder stock 10, and is preferably disposed below the barrel of the pistol, forward of the trigger guard. In a preferred embodiment, pistol 103 is modified to provide a lamp switch in the grip. An electrical connection between the tactical lamp and the lamp switch is preferably by means of electrical cables that are imbedded in the pistol frame 12.

Many variations of the invention will occur to those skilled in the art. Some variations include a wire stock. Other variations call for a polymer stock. All such variations are intended to be within the scope and spirit of the invention.

Although some embodiments are shown to include certain features, the applicant specifically contemplates that any feature disclosed herein may be used together or in combination with any other feature on any embodiment of the invention. It is also contemplated that any feature may be specifically excluded from any embodiment of the invention.

What is claimed is:

1. A pistol carrier system for use with a belt and a pistol comprising a frame and having a transverse slot at the bottom of the frame and two transverse holes in the upper rear of the frame, said pistol carrier system comprising:

a shoulder stock comprising a stock body having a butt, a downward extension having a cross pin that is adapted for engagement with the transverse slot, and a clamp having two studs that are adapted for engagement with the two transverse holes;

a slide assembly that is slidably mounted on said stock body, said slide assembly comprising a slide detent mechanism that is operative to temporarily maintain said slide assembly at a selected position on said stock body, and a slide tongue having a slide hook;

a supporting box that is attachable to the belt, said supporting box having an opening and a cavity that are adapted for receiving and retaining said slide tongue.

2. The pistol carrier system of claim 1 wherein said supporting box comprises within said cavity a detent lever comprising:

a detent lever lower arm and a detent lever upper arm comprising a detent cam;

a detent lever spring that urges said detent cam into engagement with said slide hook; and a sliding bar comprising a sliding bar stud that is operative to move said detent lower lever arm between an unlocked position at which said detent cam is not engaged with said slide hook and a locked position at which said detent cam is engaged with said slide hook, said sliding bar being slidable between a high retention position that corresponds with said locked position and a low retention position that corresponds to said unlocked position by means of a button and being maintained in said high retention position or said low retention position by a sliding bar detent mechanism.

3. The pistol carrier system of claim 1 wherein said stock body is selected from the group consisting of:

a wire stock comprising a first arm and a second arm upon which said slide assembly is slidable, said first arm having a first axis and said second arm having a second axis and being joined by said cross pin and a bridge, said second arm extending backward and being bent downward at substantially a ninety degree angle to form said butt, said first arm being extending backward and being bent downward and toward a substantially vertical plane containing said second axis of said second arm and said butt and joining said second arm, and said first arm and said second arm extending forward and then downward forming said downward extension and joining to form said cross pin; and a polymer stock comprising a rail along which said side assembly is slidable, an upper attachment clamp that supports said studs and a lower attachment clamp that supports said cross pin and having a gripping opening between said attachment clamps.

4. The pistol carrier system of claim 3 further comprising:

a holster to which said wire stock is attachable when it is disengaged from the pistol, said holster comprising a holster supporting tongue that is supported by said supporting box when said slide tongue is not supported by said supporting box.

5. The pistol carrier system of claim 1 wherein said should stock further comprises an upper attachment point and a lower attachment point, and said pistol carrier system further comprises:

an adjustable sling comprising a cord that is slidably connected to said upper attachment point, a buckle and two snap hooks, one snap hook being fixed to said lower attachment point and the other being fixed to said buckle.

6. The pistol carrier system of claim 5 wherein said buckle has a buckle eye and a buckle hole through which said cord passes, and said buckle comprises a buckle lever, one end of which is urged against said cord by a buckle spring and another end of which is depressible.

7. The pistol carrier system of claim 1 wherein said shoulder stock comprises an arm or rail having a plurality of slots, said slide assembly comprises a sliding bar having a relief cavity, and said slide detent mechanism comprises a lower detent sphere, an upper detent sphere, a detent spring and a detent cylinder that is disposed in said detent spring, said slide detent mechanism urging said lower detent sphere into one of said slots when said sliding bar is in a locked location and urging said upper detent sphere into said relief cavity when said sliding bar is in an unlocked location.

8. A pistol carrier system for use with a pistol comprising a frame and having a transverse slot at the bottom of the frame and two transverse holes in the upper rear of the frame, said pistol carrier system comprising:

a shoulder stock comprising a stock body comprising a butt having a lower apex, a cross pin that is adapted for engagement with the transverse slot and two studs that are adapted for engagement with the two transverse holes, said stock body having a shoulder stock length;

a slide assembly that is slidably mounted on said stock body, said slide assembly comprising a slide tongue having a slide hook; and a supporting box having an opening that is adapted for receiving said slide tongue, said supporting box comprising a detent lever comprising a detent lever lower arm and a detent lever upper arm comprising a detent cam, a detent lever spring that urges said detent cam into engagement with said slide hook, and a sliding bar comprising a sliding bar stud that is operative to move said detent lower lever arm to a position at which said detent cam is not engaged with said slide hook.

9. The pistol carrier system of claim 8 wherein said stock body is selected from the group consisting of:

a wire stock comprising a first arm and a second arm upon which said slide assembly is slidable, said first arm having a first axis and said second arm having a second axis and being joined by said cross pin and a bridge, said second arm extending backward and being bent downward at substantially a ninety degree angle to form said butt, said first arm being extending backward and being bent downward and toward a substantially vertical plane containing said second axis of said second arm and said butt and joining said second arm, and said first arm and said second arm extending forward and then downward forming said downward extension and joining to form said cross pin; and a polymer stock comprising a rail along which said side assembly is slidable, an upper attachment clamp that supports said studs and a lower attachment clamp that supports said cross pin and having a gripping opening between said attachment clamps.

10. The pistol carrier system of claim 8 wherein said shoulder stock further comprises an upper attachment point located at a distance from the pistol that is no greater than about half said shoulder stock length and a lower attachment point located at said lower apex of said butt, and said pistol carrier system further comprises:

an adjustable sling comprising a cord that is slidably connected to said upper attachment point, a buckle and two snap hooks, one snap hook being fixed to said lower attachment point and the other being fixed to said buckle.

11. The pistol carrier system of claim 10 wherein said buckle has a buckle eye and a buckle hole through which said cord passes, and said buckle comprises a buckle lever, one end of which is urged against said cord by a buckle spring and another end of which is depressible.

12. The pistol carrier system of claim 8 further comprising:

a holster to which said wire stock is attachable when it is disengaged from the pistol, said holster comprising a holster supporting tongue that is supported by said supporting box when said slide tongue is not supported by said supporting box.

13. The pistol carrier system of claim 8 wherein said shoulder stock comprises an arm or rail having a plurality of slots, said slide assembly comprises a sliding bar having a relief cavity, and said slide detent mechanism comprises a lower detent sphere, an upper detent sphere, a detent spring and a detent cylinder that is disposed in said detent spring, said slide detent mechanism urging said lower detent sphere into one of said slots when said sliding bar is in a locked location and urging said upper detent sphere into said relief cavity when said sliding bar is in an unlocked location.

14. A shoulder weapon carrier system comprising:

a pistol comprising a frame and having a transverse slot at the bottom of the frame and two transverse holes in the upper rear of the frame;

a shoulder stock comprising a stock body comprising a butt, a cross pin that is adapted for engagement with the transverse slot and two studs that are adapted for engagement with the two transverse holes;

a slide assembly that is slidably mounted on said stock body, said slide assembly comprising a slide tongue having a slide hook; and a supporting box having an opening that is adapted for receiving said slide tongue, said supporting box comprising a detent lever comprising a detent lever lower arm and a detent lever upper arm comprising a detent cam, a detent lever spring that urges said detent cam into engagement with said slide hook, and a sliding bar comprising a sliding bar stud that is operative to move said detent lower lever arm to a position at which said detent cam is not engaged with said slide hook.

15. The shoulder weapon carrier system of claim 14 wherein said stock body is selected from the group consisting of:

a wire stock comprising a first arm and a second arm upon which said slide assembly is slidable, said first arm having a first axis and said second arm having a second axis and being joined by said cross pin and a bridge, said second arm extending backward and being bent downward at substantially a ninety degree angle to form said butt, said first arm being extending backward and being bent downward and toward a substantially vertical plane containing said second axis of said second arm and said butt and joining said second arm, and said first arm and said second arm extending forward and then downward forming said downward extension and joining to form said cross pin; and a polymer stock comprising a rail along which said side assembly is slidable, an upper attachment clamp that supports said studs and a lower attachment clamp that supports said cross pin and having a gripping opening between said attachment clamps.

16. The shoulder weapon carrier system of claim 14 wherein said should stock further comprises an upper attachment point and a lower attachment point, and said pistol carrier system further comprises:

an adjustable sling comprising a cord that is slidably connected to said upper attachment point, a buckle and two snap hooks, one snap hook being fixed to said lower attachment point and the other being fixed to said buckle.

17. The shoulder weapon carrier system of claim 14 wherein said buckle has a buckle eye and a buckle hole through which said cord passes, and said buckle comprises a buckle lever, one end of which is urged against said cord by a buckle spring and another end of which is depressible.

18. The pistol carrier system of claim 14 further comprising: a laser aiming device that is attached either to said pistol or to said shoulder stock.

19. A weapon comprising:

a pistol comprising a frame comprising a bottom portion and an upper rear portion and having a transverse slot in said bottom portion and two transverse holes in said upper rear portion; and a shoulder stock comprising a stock body comprising a butt, a cross pin that is adapted for engagement with said transverse slot, and two studs that are adapted for engagement with said two transverse holes.

* * * * *